US005476314A

United States Patent [19]

Nishiki

[11] Patent Number: 5,476,314

[45] Date of Patent: Dec. 19, 1995

[54] VIDEO PROJECTING APPARATUS FOR MULTI-STACKING USE

[75] Inventor: Nobuhiko Nishiki, Kanagawa, Japan

[73] Assignee: Sony Corporation, Tokyo, Japan

[21] Appl. No.: 342,096

[22] Filed: Nov. 18, 1994

Related U.S. Application Data

[63] Continuation of Ser. No. 127,130, Sep. 27, 1993, abandoned, which is a continuation of Ser. No. 861,014, Mar. 31, 1992, abandoned.

[30] Foreign Application Priority Data

Apr. 5, 1991 [JP] Japan ..... 3-099705

[51] Int. Cl.[6] ..... A47B 81/06

[52] U.S. Cl. ..... 312/7.2; 312/10.1; 312/244; 353/119

[58] Field of Search ..... 312/7.2, 10.1, 312/223.1, 223.2, 244; 248/551, 552, 553, 917; 353/74, 79, 94, 119; 40/560, 605, 624; 348/836, 839, 840

[56] References Cited

U.S. PATENT DOCUMENTS

| | | | |
|---|---|---|---|
| 3,541,256 | 11/1970 | Anders | 358/254 |
| 4,203,636 | 5/1980 | Wells | 358/254 X |
| 4,756,615 | 7/1988 | Hildebrand | 353/74 |
| 4,903,137 | 2/1990 | Wakasa | 358/254 |
| 5,148,282 | 9/1992 | Sedighzadeh | 312/7.2 X |
| 5,240,119 | 8/1993 | Feldman | 248/917 X |
| 5,249,005 | 9/1993 | Furuno | 353/94 |

FOREIGN PATENT DOCUMENTS

| | | | |
|---|---|---|---|
| 1218858 | 5/1960 | France | 353/119 |
| 2645728 | 10/1990 | France | 312/7.2 |

*Primary Examiner*—Brian K. Green
*Attorney, Agent, or Firm*—Jay H. Maioli

[57] ABSTRACT

A video projection apparatus for multi-stacking use comprises a pipe-shaped member of a frame configuration formed around side walls of a video projector body having a video projector, and a space portion formed along the pipe-shaped member. Therefore, carrying and stacking this video projection apparatus is facilitated.

6 Claims, 3 Drawing Sheets

VIDEO PROJECTING APPARATUS FOR MULTI-STACKING USE

This is a continuation of application Ser. No. 08/127,130, filed Sep. 27, 1993, now abandoned, which was in turn a continuation of application Ser. No. 07/861,014, filed Mar. 31, 1992 now abandoned.

BACKGROUND OF THE INVENTION

1. Field of the Invention

The present invention relates generally to video display apparatus such as a video projector or the like and, more particularly to an external shape of a video projection apparatus for multi-stacking use.

2. Description of the Related Art

A video display apparatus, such as a video projector, a cathode ray tube (CRT) or the like is utilized not only as a single video display apparatus for displaying a video image but also as a so-called multi-billboard (i.e., multi-video system) in which a plurality of adjacent rear projection type video projectors are installed in the horizontal and vertical directions so as to perform a variety of video production by combining video images displayed on a plurality of picture screens. Since this multi-video system can directly display video images on individual projector screens in an enlarged pattern and the like, it can impress the viewers strongly and provide a video image of sufficiently high quality and brightness.

In order to carry the video display apparatus such as the video projector, the CRT or the like or in order to stack the video display apparatus as the multi-billboard, the video display apparatus has handles formed on both side walls of the housing of the video display apparatus so that the workers can carry the video display apparatus. However, according to the conventional video display apparatus having the handles, such handles unavoidably limit the number of workers to carry the apparatus and also the positions of the workers. Particularly, when the video display apparatus are stacked as the multi-billboard in the longitudinal direction, such stacking work is difficult and dangerous for the workers. Further, the handles cannot be utilized effectively except for carrying the video display apparatus.

OBJECTS AND SUMMARY OF THE INVENTION

Therefore, it is an object of the present invention to provide an improved video projection apparatus for multi-stacking use in which the aforesaid shortcomings and disadvantages encountered with the related art can be eliminated.

More specifically, it is an object of the present invention to provide a video projection apparatus for multi-stacking use which is easy to carry and easy to stack.

It is another object of the present invention to provide a video projection apparatus for multi-stacking use which can be held at a desired position.

It is a further object of the present invention to provide a video projection apparatus for multi-stacking use which can be used as a multi-billboard.

According to an aspect of the present invention, a video projection apparatus for multi-stacking use comprises a pipe-shaped member of a frame configuration formed around side walls of a video projector body having a video projector, and a space portion formed along the pipe-shaped member.

BRIEF DESCRIPTION OF THE DRAWINGS

A better understanding of other objects, features, and advantages of the present invention will become apparent from the following detailed description of an illustrative embodiment thereof, in conjunction with the figures of the accompanying drawings, in which.

DESCRIPTION OF THE PREFERRED EMBODIMENT

The present invention will now be described with reference to the accompanying drawings.

Figure 1:
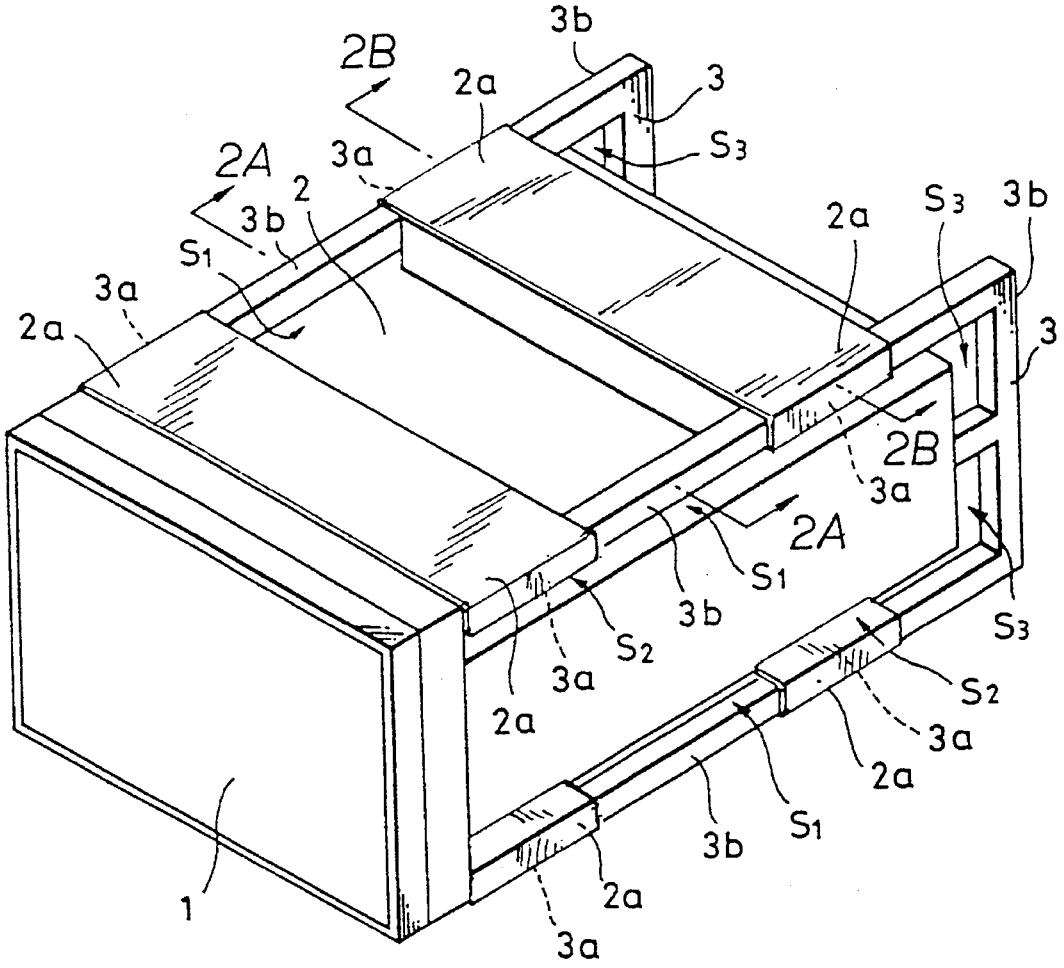
FIG. 1 is a perspective view illustrating a video projection apparatus for multi-stacking use according to an embodiment of the present invention.
Figure 2A:
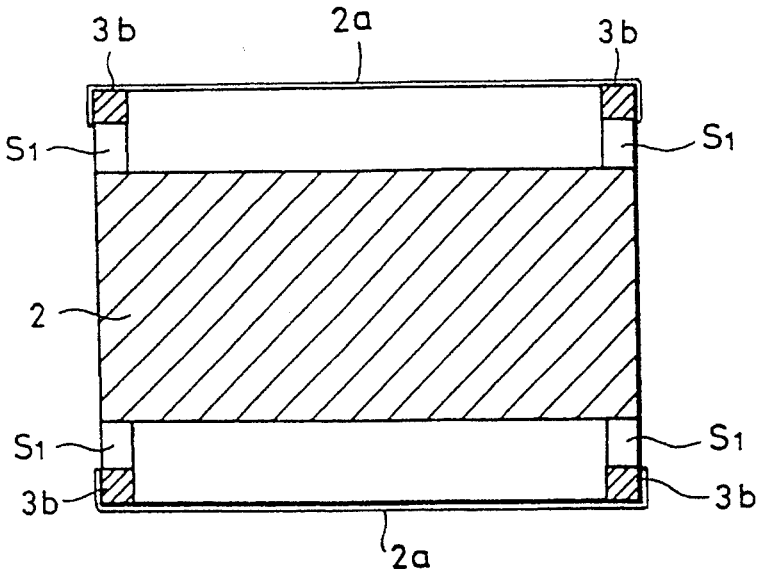
FIG. 2A is a cross-sectional view taken through the line 2A—2A in FIG. 1.
Figure 2B:
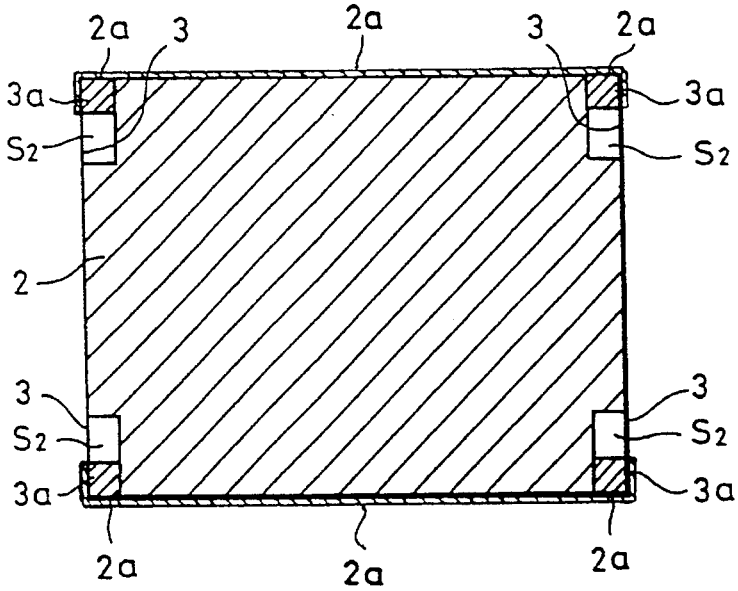
FIG. 2B is a cross-sectional view taken through the line 2B—2B in FIG. 1.

FIG. 1 of the accompanying drawings shows a perspective view of an external appearance of a video projector provided as a video projection apparatus according to the present invention. FIGS. 2A and 2B are cross-sectional views taken along the lines 2A—2A and 2B—2B in FIG. 1, respectively. In FIGS. 2A and 2B, a projection mechanism installed within a video display apparatus is not shown.

Referring to the figures, there are shown a screen 1 and a video projector body or housing 2 which houses a video projection mechanism (not shown). A square pipe 3 of a frame-like configuration is provided around respective side surfaces of the projector body 2 and the video projector body 2 is secured to the inside of the frame made by the square pipe 3. The square pipe 3 is composed of a covered or non-exposed portion *3a* covered with an aluminum plate member *2a* which is a part of the video projector body 2 and an exposed portion *3b* exposed from the video projector body 2. As shown in FIG. 2A, the exposed portion *3b* is exposed in the entire circumferential direction thereof and a space portion $S_1$ is formed between the exposed portion *3b* and the video projector body 2. Also, as shown in FIG. 2B, as to the non-exposed portion *3a*, a space portion $S_2$ is provided between the projector body 2 and the aluminum plate member *2a* which covers the square pipe 3.

Figure 3:
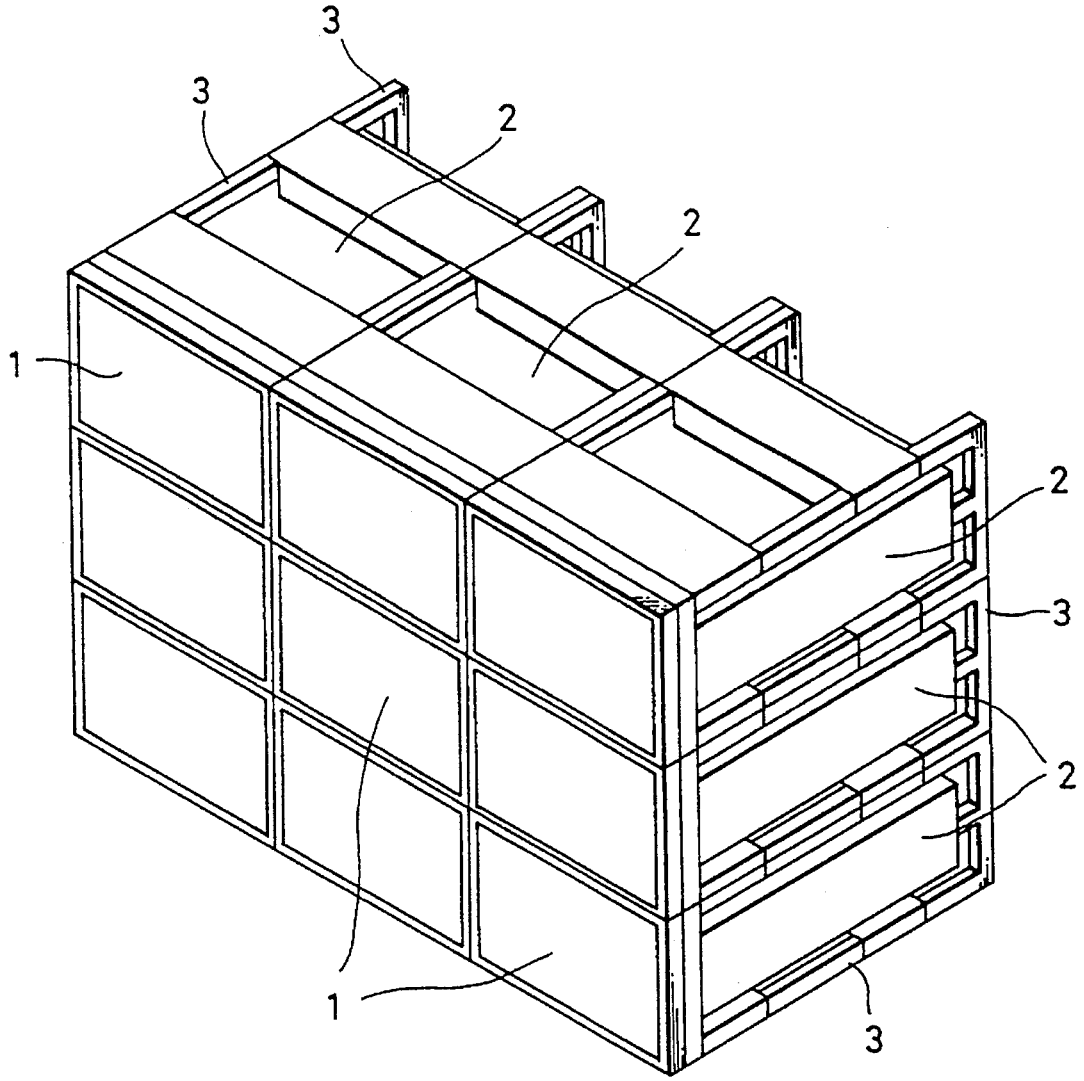
FIG. 3 is a perspective view illustrating the condition such that a plurality of video projection apparatus according to this embodiment are disposed as a multi-billboard (multi-video system).

Accordingly, the workers can lift the video projection apparatus by gripping the exposed portion *3b* of the square pipe 3 with hands. Although the workers cannot hold the square pipe 3 at its non-exposed portion *3a*, the workers can lift this video projection apparatus with hands by using the space portion $S_2$. That is, the workers can lift this video projection apparatus by using the square pipe 3 irrespective of the positions of the respective side surfaces of the housing. Therefore, the number of workers and the place at which the video projection apparatus is lifted are not limited. Further, since the upper and lower ends of the side walls of the video projection apparatus can both be used as handles, this video projection apparatus of the present invention is particularly useful when a plurality of video projection apparatus are stacked. Consequently, according to the video projection apparatus of this embodiment, a working property can be considerably improved not only when this video projection apparatus is carried but also when a plurality of video projection apparatus are stacked in the form of a multi-billboard as shown in FIG. 3. In addition, a risk in the above-mentioned cases also can be reduced.

Further, when a plurality of video projection apparatus are disposed as the multi-billboard, there is then the advantage such that reinforcing rods, plates or the like for the plurality of video projection apparatus can be inserted in the horizontal direction through the space portions $S_1$ thereof after the plurality of video projection apparatus are disposed. Further, coupling members for stacking a plurality of video projection apparatus in the vertical directions can be attached to the square pipes 3 by effectively utilizing the exposed portions 3*b* on the rear side of the projector bodies 2 and the surrounding space portions $S_3$. Furthermore, vertical reinforcing members also can be inserted therethrough. Also, since the reinforcing members can be inserted in the vertical and horizontal directions, a tall multi-billboard can be constructed with ease.

The exposed portion 3*b* on the rear side of the video projector body 2 can be used to fix signal cables or the like led out from the projector body 2 side. Further, when the video projection apparatus of this embodiment is installed on the base table or the like, the video projection apparatus can be secured to the base table by utilizing the square pipes 3 on the lower portions of the respective side walls. Therefore, since the square pipe 3 has the exposed portion 3*b* exposed from the projector body 2, the video projection apparatus of the present invention can be utilized in a wide variety of application fields.

The external shape of the video projection apparatus according to the present invention is not limited to that of the embodiment shown in FIG. 1. Also, the arrangement of the present invention is not limited to the video projection apparatus and can be applied to other video display apparatus such as a cathode ray tube (CRT) or the like.

As described above in detail, since the video projection apparatus of the present invention comprises pipe members of frame-like configuration provided on the side walls of the housing and the portions in which the space portions are formed along the pipe members, the video projection apparatus can be carried by the workers by utilizing the pipe members without any special carry handles unlike the prior art. In addition, since the number and position of workers for carrying the video projection apparatus are not limited, a working property and a safety in the carrying and stacking video projection apparatus can be improved considerably. Further, the pipe members and the surrounding space portions can be utilized in a wide variety of purposes such as inserting the reinforcing members, mounting the fixing means or the like. Particularly when a plurality of video projection apparatus are disposed upper, lower, left and right in the form of the multi-billboard, the pipe members and the surrounding space portions become useful.

Having described the preferred embodiment of the invention with reference to the accompanying drawings, it is to be understood that the invention is not limited to that precise embodiment and that various changes and modifications thereof could be effected by one skilled in the art without departing from the spirit or scope of the invention as defined in the appended claims.

What is claimed is:

1. A plurality of video projection devices each comprising:

a video projector housing having side walls, each of said side walls having a top and a bottom;

a pipe-shaped member forming a frame that extends around at least a part of the top and a part of the bottom of said side walls; and a plurality of space portions formed along said pipe-shaped member and distributed along a plurality of said side walls so that said pipe-shaped member provides hand-holds to facilitate carrying of said video projector housing by workers;

said plurality of said video projection devices being vertically stacked and horizontally positioned during use as a multi-billboard to form an enlarged display in which said space portions are positioned relative to said enlarged display so that they are adapted to receive reinforcing means therein to reinforce said enlarged display.

2. A plurality of video projection devices according to claim 1 in which said pipe-shaped member is composed of at least one portion covered by a part of said video projector housing and at least one exposed portion.

3. A plurality of video projection devices according to claim 2 in which at least a part of said pipe-shaped member is square in cross section.

4. A plurality of video projection devices according to claim 2 in which each of said space portions includes a first space portion provided between said video projector housing and said exposed portion.

5. A plurality of video projection devices according to claim 4 in which each of said space portions includes a second space portion provided between said video projector housing and said covered portion.

6. A plurality of video projection devices according to claim 5 in which each of said space portions includes a third space portion provided between a rear side wall of said video projector housing and said exposed portion.

* * * * *